United States Patent [19]

Webb et al.

[11] Patent Number: 4,573,445

[45] Date of Patent: Mar. 4, 1986

[54] ARROW SLINGSHOT

[76] Inventors: Ted H. Webb; George Spector, both of 233 Broadway RM 3615, New York, N.Y. 10007

[21] Appl. No.: 594,031

[22] Filed: Mar. 27, 1984

[51] Int. Cl.[4] ..... F41B 3/00

[52] U.S. Cl. ..... 124/22; 124/86; 403/375

[58] Field of Search ..... 273/20 R, 20 A, 20 B, 273/21, 22, 24 R, 24 A, 25, 26, 83-85, 17, 86; 403/375

[56] References Cited

U.S. PATENT DOCUMENTS

| | | | |
|---|---|---|---|
| 1,207,025 | 12/1916 | Grigsby | 124/20 R |
| 1,375,776 | 4/1921 | Buys | 124/22 X |
| 1,434,726 | 11/1922 | Akers | 124/22 |
| 1,502,499 | 7/1924 | Deck | 124/22 X |
| 1,704,810 | 3/1929 | Sperry | 124/22 |
| 1,748,651 | 2/1930 | Holliday | 124/22 |
| 2,125,591 | 8/1938 | Smith | 124/24 R |
| 2,532,798 | 12/1950 | Wright | 124/20 B |
| 2,708,924 | 5/1955 | Hurlburt | 124/17 |
| 3,194,226 | 7/1965 | Hoff | 124/22 |
| 3,455,288 | 7/1969 | Knerr | 124/22 |
| 4,297,985 | 11/1981 | Rodriguez | 124/22 |
| 4,458,658 | 7/1984 | Blair | 124/20 B X |

*Primary Examiner*—Paul E. Shapiro

[57] ABSTRACT

A slingshot for an arrow is provided and consists of a long barrel open at both ends secured to the top portion of a handgrip and a device secured to the handgrip for propelling the arrow through the barrel.

5 Claims, 4 Drawing Figures

ARROW SLINGSHOT

BACKGROUND OF THE INVENTION

The instant invention relates generally to projectors and more specifically it relates to a slingshot for an arrow for sport, hunting or target practice.

Numerous projectors have been provided in prior art that are adapted to propell elongated projectiles. For example U.S. Pat. Nos. 2,715,895; 3,194,226 and 3,306,278 all are illustrative of such prior art. While these units may be suitable for the particular purpose to which they address, they would not be suitable for the purposed of the present invention as theretofore described.

SUMMARY OF THE INVENTION

A principle object of the present invention is to provide a slingshot for an arrow that has an improved barrel for guiding the arrow when the slingshot is operated.

Another object is to provide a slingshot for an arrow that has an improved device for propelling the arrow when the slingshot is operated.

An additional object is to provide a slingshot for an arrow that is constructed from durable material to be efficient when the slingshot is operated.

A further object is to provide a slingshot for an arrow that is simple and easy to use.

A still further object is to provide a slingshot for an arrow that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific contruction illustrated and described within the scope of the appended claims.

BRIEF DESCRIPTION OF THE DRAWING FIGURES

DETAILED DESCRIPTION OF THE PREFERRED EMBODIMENTS

Figure 1:
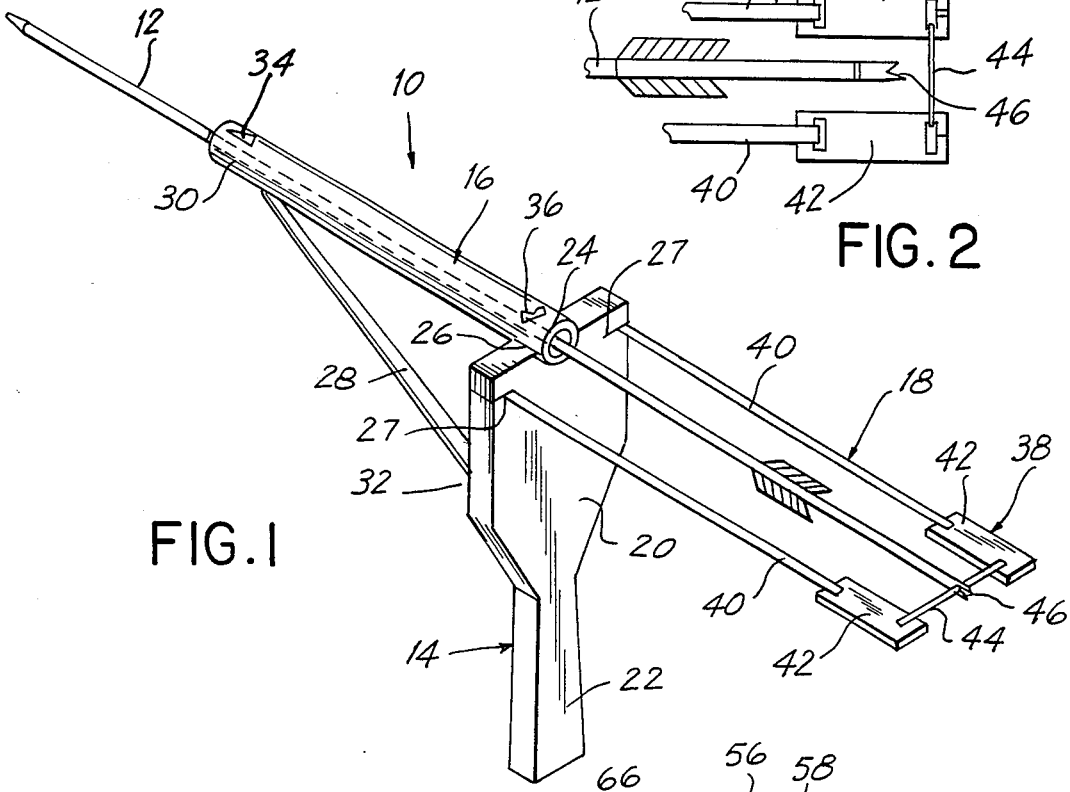
FIG. 1 is a perspective view of the invention.

Turning now descriptively to the drawings, in which similar reference characters denote similar elements throughout the several views, FIG. 1 illustrates a slingshot 10 for an arrow 12. The slingshot 10 consists of a handgrip 14, a long barrel 16 and a device 18 for propelling the arrow 12 through the barrel 16.

The handgrip 14 has a wide top portion 20 and a narrow handle portion 22. The long barrel 16 is open at both ends and is secured at the rear 24 to the top portion 18 of the handgrip 14 in a notch 26 by adhesive or the like. The device 18 is also secured to the top portion 18 of the handgrip 14 at slits 27, 27.

A brace member 28 is secured at an oblique angle between front portion 30 of the barrel 16 and forward middle portion 32 of the top portion 20 of the handgrip.

The barrel 16 contains a front sight 34 and an open rear sight 36 so that the arrow 12 can be accurately aimed.

Figure 2:
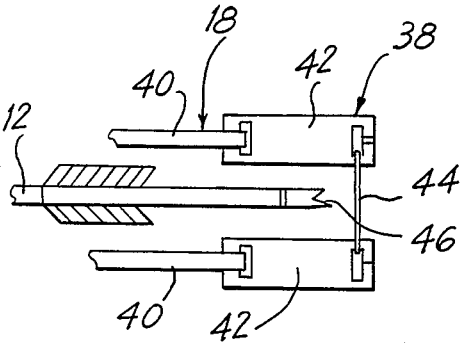
FIG. 2 is an enlarged top view of the arrow receiving nocking member.

The device 18 consists of an arrow receiving nocking member 38 and a pair of parallel elastic bands 40, 40 connecting the nocking member 38 to the top portion 20 of the handgrip 14. The nocking member 38 as best seen in FIG. 2 consists of a pair of straps 42, 42 and a wire 44. Each strap 42 is affixed at one end to one elastic band 40 while the wire 44 is affixed transversely between the pair of straps 42, 42 to engage nock 46 of the arrow 12.

Figure 3:
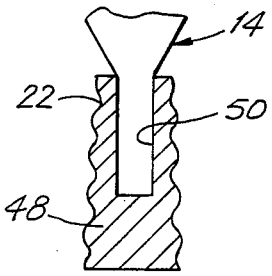
FIG. 3 is a cross sectional view of a first modification showing a finger grip handle extender.
Figure 4:
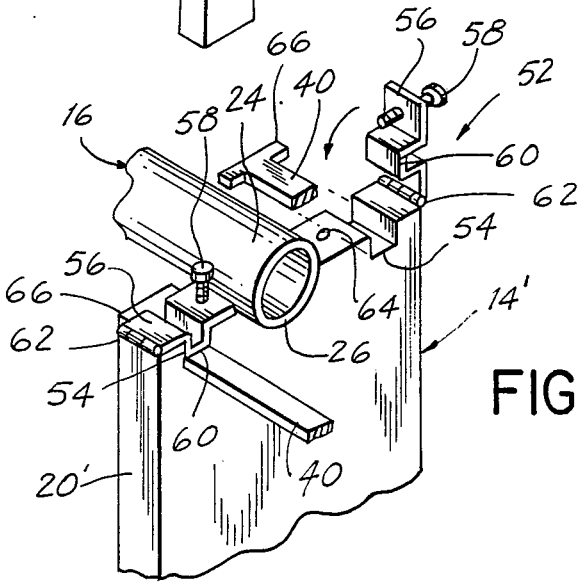
FIG. 4 is a partial perspective view of a second modification showing clamping members for the elastic bands.

FIG. 3 shows a finer grip handle extender 48 that has a central aperture 50 to engage the narrow handle portion 22 of the handgrip 14 so that user of the slingshot 10 can get a better hold on the handgrip.

The device 52 consists of the top portion 20' having a pair of parallel spaced slots 54, 54 a pair of plates 56, 56 and a pair of set screws 58, 58. The slots 54, 54 are co-extensive in length with the top portion 20'. Each slot 54 is wide enough to accommodate width of free end of one elastic band 40.

Each plate 56 has a depressed portion 60 and is hinged at one end 62 to corner of the top portion 20' of the handgrip. The plate 56 can pivot over the top portion until the depressed portion 60 will capture the free end of the elastic band 40 within the slot 54 of the top portion.

Each set screw 58 is threaded through free end of one plate 56 and into the top portion 20' of the handgrip at 64 to hold the plate securely against the top portion.

Each elastic band 40 further contains an enlarged portion 66 at the free end forming a T-shape. The free end will not pull out of the slot 54 when the plate 56 is in clamping position.

The handgrip 14 and 14', barrel 16, brace 28, handle extender 48, plates 56, 56, hinges 62, 62 and set screws 58, 58 can be made of plastic or metal. The elastic bands 40, 40 are made of rubber. The straps 42, 42 can be made of plastic or leather while the wire 44 is made out of nylon or leather.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A slingshot for an arrow which comprises:

(a) a handgrip having a wide top portion and a narrow handle portion;

(b) a long barrel open at both ends and secured to said top portion of said handgrip; and (c) means for propelling said arrow through said barrel, said means secured to said top portion of said handgrip, further comprising a brace member secured at an oblique angle between front portion of said barrel and forward middle area of said top portion of said handgrip; wherein said barrel further comprises a front sight and an open rear sight so that said arrow can be accurately aimed, wherein said means for propelling said arrow through said barrel comprises:

(d) an arrow receiving nocking member; and (e) a pair of parallel elastic bands connecting said nocking member to said top portion of said handgrip, wherein said arrow receiving nocking member comprises:

(f) a pair of straps, each of said strap affixed at one end to one said elastic band; and (g) a wire affixed transversely between said pair of straps to engage nock of said arrow.

2. A slingshot a recited in claim 1, further comprising a finger grip handle entender having a central aperture to engage said narrow handle portion of said handgrip so that user of said slingshot can get a better hold on said handgrip.

3. A slingshot as recited in claim 2, further comprising means for clamping said elastic bands to said top portion of said handgrip.

4. A slingshot as recited in claim 3, wherein said means for clamping said elastic bands to said top portion of said handgrip comprises:

(a) said top portion having a pair of parallel spaced slots co-extensive in length with said top portion, each said slot being wide enough to accomodate width of free end of said elastic band;

(b) a pair of plates, each plate having a depressed portion and hinged at one end to corner of said top portion of said handgrip so that said plate can pivot over said top portion until said depressed portion will capture said free end of said elastic band within said slot of said top portion; and (c) a pair of set screw each set screw threaded through free end of one said plate and into said top portion of said handgrip to hold said plate securely against said top portion.

5. A slingshot as recited in claim 4, wherein each said elastic band further comprises an enlarged portion at said free end forming a T-shape so that said free end will not pull out of said slot when said plate is in clamping position.

* * * * *